US011661258B2

(12) United States Patent
Farina et al.

(10) Patent No.: US 11,661,258 B2
(45) Date of Patent: May 30, 2023

(54) PACKAGING SYSTEM FOR STORAGE AND SHIPMENT OF SOLIDS

(71) Applicant: AVANTOR PERFORMANCE MATERIALS, LLC, Radnor, PA (US)

(72) Inventors: James Farina, Nazareth, PA (US); Nandu Deorkar, Cedar Knolls, NJ (US)

(73) Assignee: AVANTOR PERFORMANCE MATERIALS, LLC, Radnor, PA (US)

( * ) Notice: Subject to any disclaimer, the term of this patent is extended or adjusted under 35 U.S.C. 154(b) by 1212 days.

(21) Appl. No.: 16/096,870

(22) PCT Filed: Apr. 28, 2017

(86) PCT No.: PCT/US2017/030169
§ 371 (c)(1),
(2) Date: Oct. 26, 2018

(87) PCT Pub. No.: WO2017/190036
PCT Pub. Date: Nov. 2, 2017

(65) Prior Publication Data

US 2019/0135519 A1 May 9, 2019

Related U.S. Application Data

(60) Provisional application No. 62/329,568, filed on Apr. 29, 2016.

(51) Int. Cl.
*B65D 81/26* (2006.01)
*B65D 77/04* (2006.01)
(Continued)

(52) U.S. Cl.
CPC ..... *B65D 81/268* (2013.01); *B65D 77/02* (2013.01); *B65D 75/38* (2013.01); *B65D 85/70* (2013.01); *B65D 2205/00* (2013.01)

(58) Field of Classification Search
CPC ..... B65D 77/02; B65D 81/268; B65D 85/70
(Continued)

(56) References Cited

U.S. PATENT DOCUMENTS 4,813,791 A * 3/1989 Cullen ..... B65D 77/06 206/204
4,913,942 A * 4/1990 Jick ..... B01D 53/261 428/36.1
(Continued)

FOREIGN PATENT DOCUMENTS

CA 2166151 6/1996

*Primary Examiner* — Luan K Bui
(74) *Attorney, Agent, or Firm* — Hoffmann and Baron, LLP

(57) ABSTRACT

A packaging system that maintains the free flowing characteristic of solid materials contained therein. The packaging system includes a container, a cover, a vapor permeable bag, a vapor impermeable liner and at least two desiccant snakes. The vapor permeable bag has an opening for receiving solid materials and is formed from cloth or continuous fibers of high-density polyethylene that are randomly distributed and non-directional. The vapor impermeable liner surrounds the vapor permeable bag and provides a moisture barrier. The desiccant snakes are disposed between the vapor permeable bag and the liner. Each snake includes two or more desiccant packages formed from a vapor permeable material through which moisture can freely pass. The desiccant packages contain clay, silica, or molecular sieves.

20 Claims, 2 Drawing Sheets

(51) Int. Cl.
*B65D 77/02* (2006.01)
*B65D 75/38* (2006.01)
*B65D 85/00* (2006.01)

(58) Field of Classification Search
USPC ..... 206/204, 524.1, 524.4
See application file for complete search history.

(56) References Cited

U.S. PATENT DOCUMENTS

| | | | | |
|---|---|---|---|---|
| 5,443,626 | A * | 8/1995 | Kiyani | B01D 53/261 96/108 |
| 5,657,866 | A | 8/1997 | Kaneko et al. | |
| 5,660,868 | A | 8/1997 | Yeager | |
| 5,907,908 | A | 6/1999 | Cunanan et al. | |
| 6,102,198 | A | 8/2000 | Merrell | |
| 6,308,826 | B1 | 10/2001 | Merrell | |
| 6,343,458 | B1 * | 2/2002 | Merrell | B65D 77/04 53/445 |
| 9,428,317 | B2 * | 8/2016 | Kranz | B65D 81/268 |
| 2007/0095712 | A1 * | 5/2007 | Miles | B65D 81/127 206/524.8 |
| 2014/0021074 | A1 | 1/2014 | Kranz | |
| 2015/0239637 | A1 * | 8/2015 | Kranz | B65D 33/16 206/204 |

* cited by examiner

PACKAGING SYSTEM FOR STORAGE AND SHIPMENT OF SOLIDS

This application is the U.S. National Phase of, and Applicant claims priority from, International Patent Application No. PCT/US2017/030169, filed on Apr. 28, 2017, which claims priority from provisional application Ser. No. 62/329,568, filed on Apr. 29, 2016, which are incorporated herein in their entireties.

FIELD OF THE INVENTION

The present invention is a packaging system for storing and shipping granular solid materials. In particular, the present invention relates to a packaging system that minimizes the amount of moisture that is absorbed by granular solid materials.

BACKGROUND OF INVENTION

A common problem with delivering granular solids is that they have a tendency to cake (i.e., join together to form a mass) due to the presence of moisture in the solid. The moisture can come from two sources, externally and internally. Internal moisture is found on the surface of the salt and it can be released when there are changes in temperature. External moisture enters the packaging system from the environment exterior to the packaging system. Therefore, substantial efforts have been made to develop a packaging system that substantially reduces or eliminates caking of the solid contents so that they retain their free flowing characteristics.

Attempts to solve the caking of solids include adding anti-caking agents and changing the crystal size. However, none of these attempts have completely solved the problem. The addition of anti-caking agents to packages containing salts is undesirable because the anti-caking agents frequently include compounds that interfere with the pharmaceutical manufacturing process. In prior art packaging systems, powdered or crystalline compounds, such as NaCl, KI, $KNO_3$, or other organic or inorganic compounds subject to caking were packaged in bulk. The compounds were normally placed inside a fiberboard drum having a polyethylene liner. The drum was then covered with a fiberboard lid. However, the compound invariably cakes, even if measures are taken to prevent or retard caking. In some instances, the compound can cake so severely that it becomes rock solid and must be broken up or crushed before it can be used. This has been especially true of certain salts and other organic and inorganic compounds.

Salts tend to cake together during storage due to migration of free moisture present on the surface of the salt or due to migration of moisture from the outside environment. The mechanism of caking is the result of the formulation of small salt bridges between the particles due to a partial dissolving of the salt contacted by the free moisture. Over time the bridges become stronger and, when a sufficient amount of moisture is present, the product can turn into a solid unusable mass. Temperature changes in the environment help to release free moisture on the surfaces of these materials and caking increases the more the temperature changes.

A packaging system that prevents salts from caking is disclosed in U.S. Pat. No. 6,102,198 to Mallinckrodt, issued on Aug. 15, 2000, which is hereby incorporated in its entirety by reference. The Mallinckrodt packaging system utilizes a moisture permeable bag to allow the moisture to pass from the salts through the bag into the desiccants placed around the bag—either underneath, on top or on the sides of the bag. Any free moisture in the salts or that enters from the outside is trapped (i.e., absorbed) by the desiccants. However, the system has some drawbacks. Therefore, there is a need for new package systems that can remove free moisture from its contents and prevent caking until the contents of the package have been completely consumed.

The use of desiccants can also cause problems when the desiccant becomes mixed in with the contents of the package. For pharmaceutical products and solid materials used in the food industry, the contamination of a package with just a small amount of desiccant renders the contents unusable. Typically, desiccants are contained in a bag or pouch made of a permeable material, for example a cloth bag, which is mixed in with the contents of a package system and can be relatively small in size. Contamination can occur if the cloth bag ruptures and the desiccant discharges or if the user is unable to remove all of the cloth bags from a package system prior to discharging the contents into a process. Preventing the desiccant bags from rupturing can be accomplished by using stronger materials and making a stronger bag. However, no matter how well a desiccant bag is made, it still becomes a problem when it cannot be found and remains mixed in with the package contents. Therefore, there is a need for a desiccant packaging system that includes a desiccant bag that does not easily rupture and can be easily separated from the package contents.

SUMMARY OF THE INVENTION

In accordance with the present invention, a packaging system is provided that maintains the free flowing characteristic of solid materials contained therein. The packaging system comprises, consists of, or consists essentially of: a container, a cover, a vapor permeable bag, a vapor impermeable liner and at least two desiccant snakes. The container has a perimetrical side wall extending upwardly from a bottom wall to an open top. The side wall and bottom wall define an interior and a cover is removably attached to the open top to seal the interior.

The vapor permeable bag is disposed in the interior of the container and has an opening for receiving solid materials. After the vapor permeable bag is filled with a product, the opening is closed. A cable tie can be used to close the vapor permeable bag. Preferably, the vapor permeable bag is formed from cloth or continuous fibers of high-density polyethylene that are randomly distributed and non-directional.

The vapor impermeable liner surrounds the vapor permeable bag and provides a moisture barrier. The vapor impermeable liner can be made from a polymer material that includes polyethylene, polypropylene, nylon, polyester, copolymer of vinylidene chloride (PVDC), ethylene-vinyl acetate copolymer (EVA), ionomers or blends of two or more of these polymer materials. Preferably, the vapor impermeable liner comprises, consists of, or consists essentially of low density polyethylene, high density polyethylene, linear low density polyethylene, or very low density polyethylene.

At least two desiccant "snakes" are disposed between the vapor permeable bag and the liner. Preferably, a first snake is located at the bottom of the container and a second snake is located on top of the vapor permeable bag. The snakes have an identification cord. When the first snake is placed at the bottom of the container, the identification cord extends to the top of the vapor permeable bag to allow a user to identify the desiccant snake without having to remove the vapor permeable bag. In addition, one or more desiccant snakes can be placed in the vapor permeable bag before it is closed. Each snake comprises, consists of, or consists essentially of two or more desiccant packages formed from a vapor permeable material through which moisture can freely pass. Each snake desiccant package contains clay, silica, or molecular sieves. The desiccant packages can be formed from cloth or continuous fibers of high-density polyethylene that are randomly distributed and non-directional.

BRIEF DESCRIPTION OF THE FIGURES

The preferred embodiments of the packaging system of the present invention, as well as other objects, features and advantages of this invention, will be apparent from the accompanying drawings wherein.

DETAILED DESCRIPTION OF THE INVENTION

Figure 1:
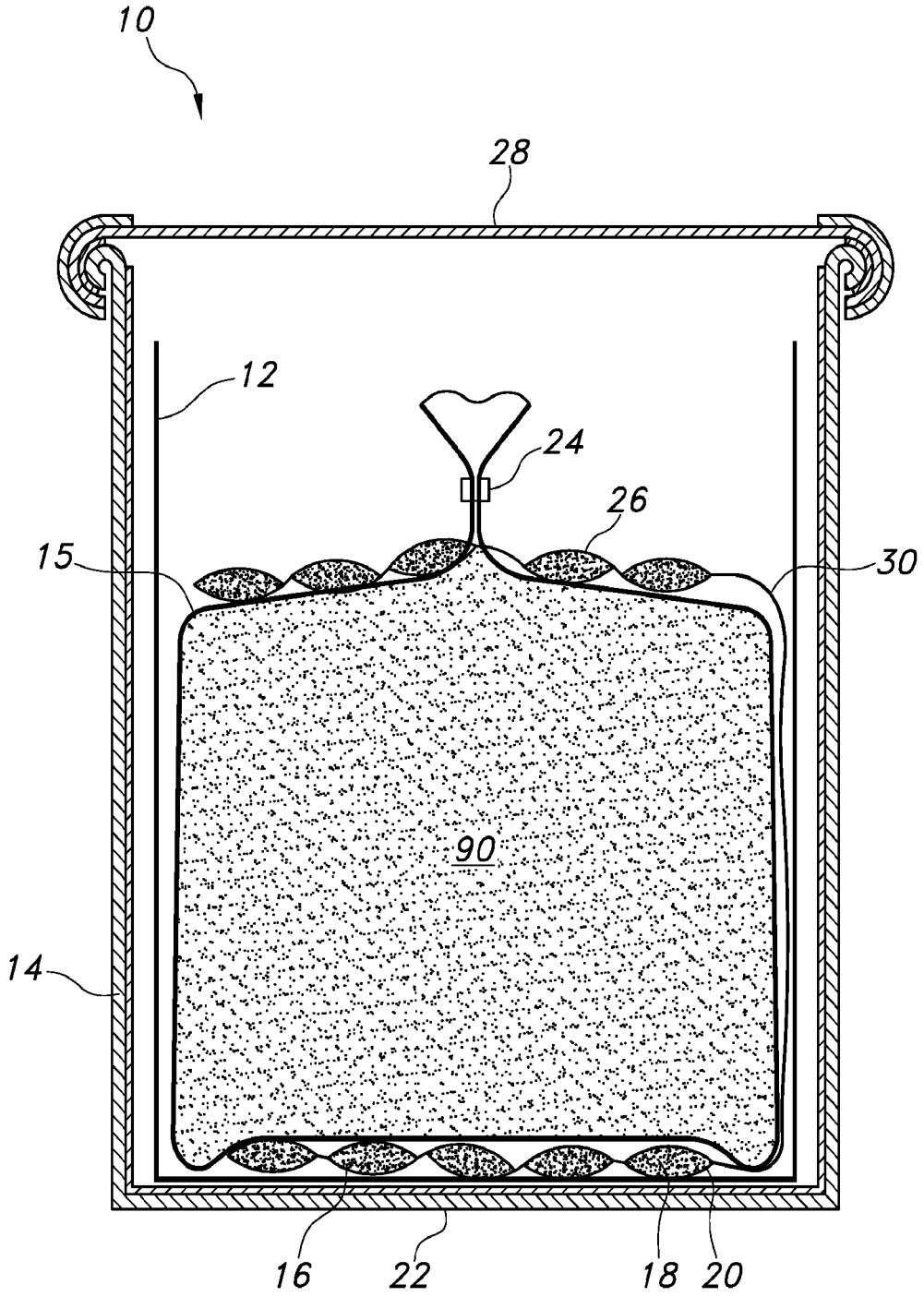
FIG. 1 shows a sectional side view of the packaging system with a desiccant snake at the top and bottom of the bag containing the product.

The present invention is a packaging system that is designed for storage and/or transportation of granular or dry materials that may experience caking due to moisture. The packaging system is especially designed for various salts and buffers (herein referred to generically as the "product") used in the manufacturing operations associated with biopharmaceuticals production. The packaging system includes a drum with a poly liner, a vapor permeable or porous bag that receives the product and at least two desiccant snakes. The term desiccant snake refers to a plurality of desiccant bags or pouches attached at their ends to form a string of bags that look like a snake. The desiccant bags can be directly attached to each other (e.g., the ends can be stitched together) or they can be connected by a string or cord. The first desiccant snake is positioned on the bottom of the drum and then the permeable bag containing the product is placed in the drum. The second desiccant snake is positioned on top of the permeable bag. This configuration assures that the product remains uniformly free flowing. The outer poly liner provides an additional moisture barrier and together with the desiccants assures maximum removal of moisture.

TYVEK® is the preferred material for the porous bag and it is manufactured by E. I. Du Pont De Nemours and Company, Wilmington Del. TYVEK® is formed using continuous and very fine fibers of high-density polyethylene, preferably 100 percent high-density polyethylene, that are randomly distributed and non-directional. These fibers are first flash spun, then laid as a web on a moving bed before being bonded together by heat and pressure—without the use of binders, sizers or fillers. By varying both the lay-down speed and the bonding conditions, the flashspun sheet can be engineered to form either soft-structure or hard-structure TYVEK®.

The liner material is preferably made of copolymers of polyethylene; although polypropylene films can also be used. For the purposes of this disclosure, the terms "polyethylene film" or "polyethylene layer" are intended to include any one of the types of polyethylene that are disclosed below, as well as multi-layer films that contain the same or different types of polyethylene, e.g., two layers of low density polyethylene in a three layer film structure or a layer of high density polyethylene and a layer of low density polyethylene. The multi-layer film structures can also include a polymer material that provides a moisture barrier or an oxygen barrier. Polyethylene is the name for a polymer whose basic structure is characterized by the chain $—(CH_2CH_2)_n$. Polyethylene homopolymer is generally described as being a solid, which has a partially amorphous phase and partially crystalline phase with a density of between 0.915 to 0.970 g/cm$^3$. The relative crystallinity of polyethylene is known to affect its physical properties. The amorphous phase imparts flexibility and high impact strength while the crystalline phase imparts a high softening temperature and rigidity.

The preferred liner material includes linear low density polyethylene (LLDPE). Only copolymers of ethylene with alpha-olefins are in this group, LLDPEs are presently recognized by those skilled in the art as having densities from 0.915 to 0.940 g/cm$^3$. The alpha-olefin utilized is usually 1-butene, 1-hexene, or 1-octene and Ziegler-type catalysts are usually employed (although Phillips catalysts are also used to produce LLDPE having densities at the higher end of the range). Very low density polyethylene (VLDPE), which is also called "ultra low density polyethylene" (ULDPE) can also be used for the liner material. This grouping, like LLDPEs, comprise only copolymers of ethylene with alpha-olefins, usually 1-butene, 1-hexene or 1-octene and are recognized by those skilled in the art as having a high degree of linearity of structure with short branching rather than the long side branches characteristic of low density polyethylene (LDPE). However, VLDPEs have lower densities than LLDPEs. The densities of VLDPEs are recognized by those skilled in the art to range between 0.860 and 0.915 g/cm$^3$.

In the packaging industry, films are known to use coextruded, extrusion coated or laminated films which utilize such compositions as LLDPE, nylon, polyester, copolymer of vinylidene chloride (PVDC), ethylene-vinyl acetate copolymer (EVA) and ionomers. It is generally known that selection of films for packaging pharmaceutical products includes consideration of one or more criteria such as puncture resistance, cost, sealability, stiffness, strength, printability, durability, barrier properties, machinability, optical properties such as haze and gloss, flex-crack resistance and government approval for contact with pharmaceutical products. The type of polyethylene selected for use in the present invention and the thickness of the film (or layer for a multi-layer film) will depend on these considerations, as well as the size of the inner and outer bags and the estimated weight of the product.

The desiccants are connected to each other to make it easier for the end-user to remove them from the drum. The bottom descant snake can have a tail (i.e. a string or cord attached to the end), preferably brightly colored, for example red, yellow or orange, that extends from the bottom of the drum to above the bag holding the product. The tail provides a visible sign that the desiccant is at the bottom of the barrel so that it can be quickly and easily removed by the end user. Attaching a plurality of desiccant packages together to form the desiccant snake makes it more difficult for the desiccant to fall into the product, which is a frequent problem when individual desiccant bags are used. In some embodiments, the drum has a recess in the bottom surface that holds the desiccant in place so that it doesn't move during shipment.

The desiccant snake includes a plurality of desiccant packages (also referred to herein interchangeably as desiccant bags and desiccant pouches) that are attached together so that they do not separate during use. The desiccant packages are formed from a vapor permeable material, such as cloth or TYVEK®, so that moisture can freely and easily pass through the packages and be absorbed by the desiccant therein. Typically, desiccant packages are available in different sizes for different applications. The package sizes are identified in units. The term "unit" is defined in Military Specification MIL Spec 3464, Type I & II for packaging as a quantity of desiccant, which will absorb a set percentage of its weight at certain levels of humidity. For the purposes of the present specification, one "unit" is equal to one ounce of desiccant. For example, an "8 unit" package contains eight ounces of desiccant. A preferred source for desiccant packages is Desiccare, Inc. of Reno, Nev.

The packaging system, with the desiccant snakes (i.e., the desiccants connected together with a long string type retrieval system on the end), enables the end user to remove the desiccant as a complete system—instead of fishing around the drum for several individual packages. Another advantage of the string-type retrieval system is that the end string is placed on the top of the bag inside the drum, which alerts the end user to the presence of desiccants on the bottom. This is important to customers who use these materials in drug manufacture where a single desiccant package can contaminate an entire production line.

Referring now to the drawings, FIG. 1 shows the packaging system 10 that includes a poly liner 12 (preferably made from linear low density polyethylene—"LLDPE") placed inside a drum 14 to line the drum 14 and a permeable (e.g., TYVEK®) bag 15 filled with product 90. A first desiccant snake 16 is shown as five bags of eight unit desiccant (about 8 ounces of desiccant in each bag) connected together in a snake configuration. The desiccant snake 16 is formed by a plurality of desiccant packages 17, each containing desiccant material 18 inside a porous (e.g., TYVEK®) sealed bag 20, the desiccant material 18 is preferably clay but silica and molecular sieves can also be used. The desiccant snake 16 is spread out on the bottom 22 of the drum 14. The permeable bag 15 is placed on top of the desiccant snake 16 on the bottom 22 the drum 14. The permeable bag 15 is filled with product 90 and sealed with a closing mechanism 24, such as a cable tie. A second desiccant snake 26, preferably a five unit desiccant snake, is placed on the top of the permeable bag 15. The outer poly liner 12 is then sealed and the cover 28 installed on the drum 14. A cord 30 is attached to the first desiccant snake 16 and it extends to the top of the permeable bag 15 to indicate the presence of the desiccant snake 16.

Figure 2:
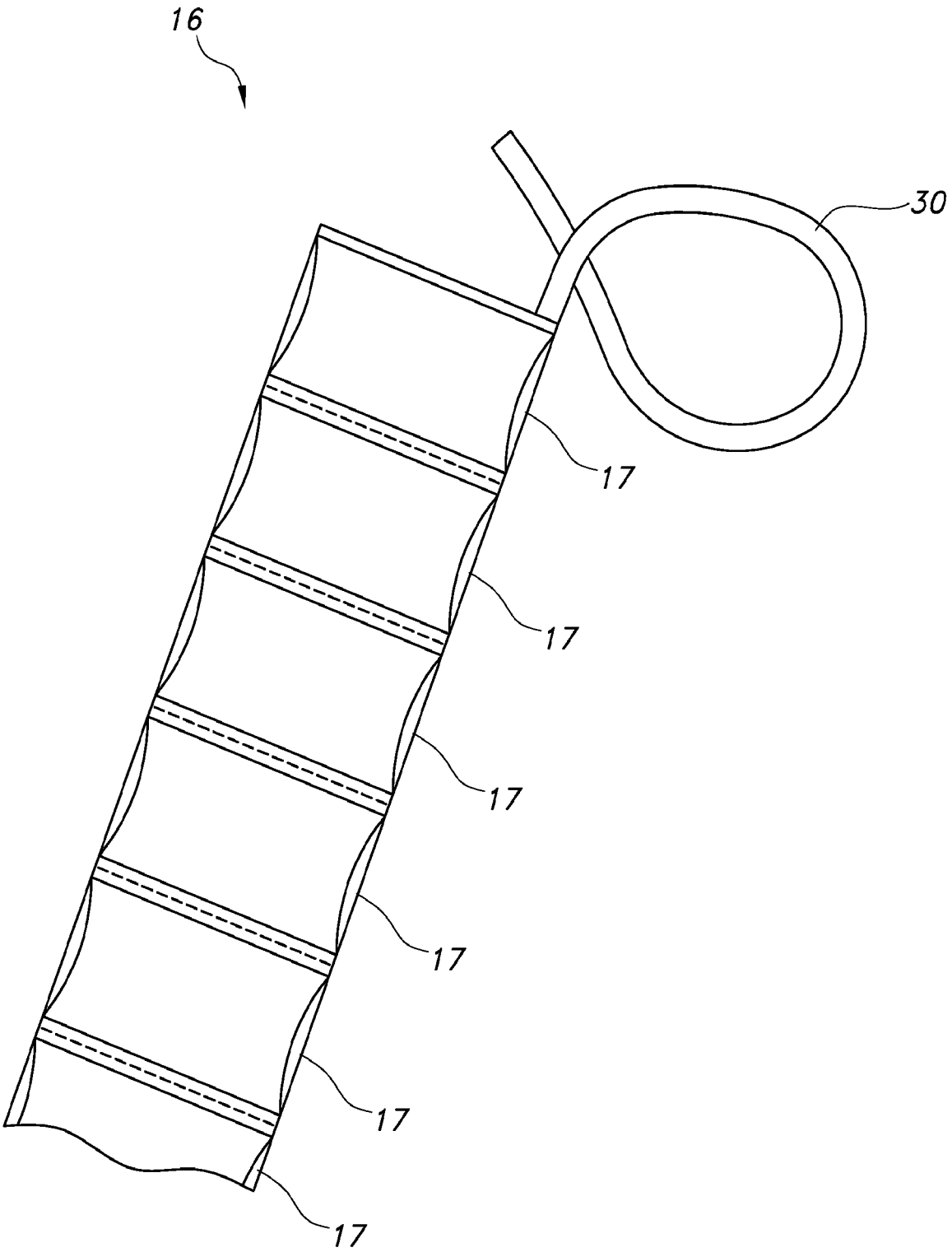
FIG. 2 shows a peripheral view of a desiccant snake with a cord attached to one end.

FIG. 2 shows a desiccant snake 16 with a plurality of 8-unit desiccant packages 17 attached to an identification cord 30. When the desiccant snake 16 is placed on the bottom 22 of the drum 14 (see FIG. 1), the identification cord 30 alerts the user to its presence so that it can be removed.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A packaging system that maintains the free flowing characteristic of solid materials contained therein, the packaging system comprising:

a container having a perimetrical side wall extending upwardly from a bottom wall to an open top, wherein the perimetrical side wall and bottom wall define an interior;

a cover removably attached to the open top to seal the interior;

a vapor permeable bag in the interior of the container, the vapor permeable bag comprising an opening for receiving a product, wherein, after the vapor permeable bag receives the product, the opening is closed;

a vapor impermeable liner surrounding the vapor permeable bag; and at least two desiccant snakes disposed between the vapor permeable bag and the liner, wherein a first snake is located at the bottom of the container and has an identification cord that extends to the top of the vapor permeable bag, and wherein a second snake is located on top of the vapor permeable bag.

2. The packaging system according to claim 1, wherein the product is placed inside the vapor permeable bag before the opening is closed.

3. The packaging system according to claim 1, wherein a cable tie is used to close the vapor permeable bag.

4. The packaging system according to claim 1, wherein the vapor permeable bag is formed from cloth or continuous fibers of high-density polyethylene that are randomly distributed and non-directional.

5. The packaging system according to claim 1, wherein one or more desiccant snakes are placed in the vapor permeable bag before it is closed.

6. The packaging system according to claim 1, wherein each snake comprises two or more desiccant packages formed from a vapor permeable material through which moisture can freely pass.

7. The packaging system according to claim 1, wherein each snake comprises two or more desiccant packages containing clay, silica or molecular sieves.

8. The packaging system according to claim 1, wherein each snake comprises two or more desiccant packages formed from cloth or continuous fibers of high-density polyethylene that are randomly distributed and non-directional.

9. The packaging system according to claim 1, wherein the vapor impermeable liner comprises polyethylene, polypropylene, nylon, polyester, copolymer of vinylidene chloride (PVDC), ethylene-vinyl acetate copolymer (EVA), or ionomers.

10. The packaging system according to claim 1, wherein the vapor impermeable liner comprises low density polyethylene, high density polyethylene, linear low density polyethylene, or very low density polyethylene.

11. A packaging system that maintains the free flowing characteristic of solid materials contained therein, the packaging system comprising:

a container having a perimetrical side wall extending upwardly from a bottom wall to an open top, wherein the side wall and bottom wall define an interior;

a cover removably attached to the open top to seal the interior;

a vapor permeable bag disposed in the interior of the container, the vapor permeable bag comprising an opening for receiving a product, wherein, after the vapor permeable bag is filled with the product, the opening is closed;

a vapor impermeable liner surrounding the vapor permeable bag; and at least two desiccant snakes disposed between the vapor permeable bag and the liner, wherein each snake comprises two or more desiccant packages formed from a vapor permeable material through which moisture can freely pass, wherein each snake has an identification cord that extends to the top of the vapor permeable bag, and wherein each desiccant package is formed from cloth or continuous fibers of high-density polyethylene that are randomly distributed and non-directional.

12. The packaging system according to claim 11, wherein the product is placed inside the vapor permeable bag before the opening is closed.

13. The packaging system according to claim 11, wherein a cable tie is used to close the vapor permeable bag.

14. The packaging system according to claim 11, wherein the vapor permeable bag is formed from cloth or continuous fibers of high-density polyethylene that are randomly distributed and non-directional.

15. The packaging system according to claim 11, wherein each desiccant package contains clay, silica or molecular sieves.

16. The packaging system according to claim 11, wherein the vapor impermeable liner comprises polyethylene, polypropylene, nylon, polyester, copolymer of vinylidene chloride (PVDC), ethylene-vinyl acetate copolymer (EVA), or ionomers.

17. A packaging system that maintains the free flowing characteristic of solid materials contained therein, the packaging system comprising:

a container having a perimetrical side wall extending upwardly from a bottom wall to an open top, wherein the side wall and bottom wall define an interior;

a cover removably attached to the open top to seal the interior;

a vapor permeable bag disposed in the interior of the container, the vapor permeable bag comprising an opening for receiving a product, wherein the vapor permeable bag is formed from cloth or continuous fibers of high-density polyethylene that are randomly distributed and non-directional, and wherein, after the bag is filled with the product, the opening is closed;

a vapor impermeable liner surrounding the vapor permeable bag; and at least two desiccant snakes disposed between the vapor permeable bag and the liner, wherein each snake comprises two or more desiccant packages formed from a vapor permeable material through which moisture can freely pass, wherein each snake has an identification cord that extends to the top of the vapor permeable bag, and wherein each desiccant package is formed from cloth or continuous fibers of high-density polyethylene that are randomly distributed and non-directional.

18. The packaging system according to claim 17, wherein a cable tie is used to close the vapor permeable bag.

19. The packaging system according to claim 17, wherein each desiccant package contains clay, silica or molecular sieves.

20. The packaging system according to claim 17, wherein the vapor impermeable liner comprises polyethylene, polypropylene, nylon, polyester, copolymer of vinylidene chloride (PVDC), ethylene-vinyl acetate copolymer (EVA), or ionomers.

* * * * *